US008840270B2

(12) United States Patent
Schwalenberg et al.

(10) Patent No.: US 8,840,270 B2
(45) Date of Patent: Sep. 23, 2014

(54) LUMINAIRE AND TRAFFIC ROUTE ILLUMINATION DEVICE

(75) Inventors: Simon Schwalenberg, Donaustauf (DE); Peter Brick, Regensburg (DE); Julius Muschaweck, Gauting (DE)

(73) Assignee: OSRAM GmbH, Munich (DE)

( * ) Notice: Subject to any disclaimer, the term of this patent is extended or adjusted under 35 U.S.C. 154(b) by 58 days.

(21) Appl. No.: 13/512,881

(22) PCT Filed: Nov. 25, 2010

(86) PCT No.: PCT/EP2010/068247

§ 371 (c)(1), (2), (4) Date: Aug. 1, 2012

(87) PCT Pub. No.: WO2011/064313

PCT Pub. Date: Jun. 3, 2011

(65) Prior Publication Data

US 2012/0299464 A1 Nov. 29, 2012

(30) Foreign Application Priority Data

Nov. 30, 2009 (DE) ..... 10 2009 056 385

(51) Int. Cl.
*H05B 33/02* (2006.01)

(52) U.S. Cl.
USPC ..... 362/245; 362/308; 362/520

(58) Field of Classification Search
CPC ..... F21V 5/04
USPC ..... 362/245, 308, 302, 520, 518, 328, 362/311.02
See application file for complete search history.

(56) References Cited

U.S. PATENT DOCUMENTS

| | | | | |
|---|---|---|---|---|
| 4,859,043 | A | 8/1989 | Carel et al. | |
| 6,550,941 | B1 | 4/2003 | Keuper et al. | |
| 6,582,103 | B1 | 6/2003 | Popovich et al. | |
| 6,773,135 | B1 | 8/2004 | Packer | |
| 6,814,475 | B2 * | 11/2004 | Amano | 362/487 |
| 6,951,415 | B2 | 10/2005 | Amano et al. | |
| 2004/0027833 | A1 | 2/2004 | Amano et al. | |
| 2006/0007692 | A1 | 1/2006 | Hsien | |
| 2008/0232132 | A1 | 9/2008 | Graf et al. | |
| 2008/0266893 | A1 | 10/2008 | Speier | |
| 2010/0165623 | A1 | 7/2010 | Bremerich et al. | |
| 2011/0110083 | A1 * | 5/2011 | Pahlke et al. | 362/245 |
| 2011/0188242 | A1 | 8/2011 | Brick et al. | |

FOREIGN PATENT DOCUMENTS

| | | |
|---|---|---|
| CN | 1450303 | 10/2003 |
| DE | 102 43 373 | 5/2003 |
| DE | 60037965 | 1/2009 |

(Continued)

*Primary Examiner* — Elmito Breval
(74) *Attorney, Agent, or Firm* — Cozen O'Connor

(57) ABSTRACT

In at least one embodiment of the luminaire (1), it includes at least one optoelectronic semiconductor device (4) and at least one primary optical unit (11) which is disposed downstream of the semiconductor device (4) and is spaced apart therefrom. Furthermore, the luminaire (1) comprises a secondary optical unit (22) and/or a tertiary optical unit (33) which is/are disposed downstream of the primary optical unit (11). A proportion of at least 30% of radiation emitted by the semiconductor device (4) passes to the secondary optical unit (22) and/or to the tertiary optical unit (33). Furthermore, the secondary optical unit (22) and/or the tertiary optical unit (33) is/are arranged for small-angle scattering of the radiation emitted by the semiconductor device (4).

12 Claims, 6 Drawing Sheets

(56) References Cited

FOREIGN PATENT DOCUMENTS

| | | |
|---|---|---|
| DE | 10 2007 05640 | 5/2009 |
| DE | 10 2008 007723 | 8/2009 |
| DE | 10 2008 06336 | 7/2010 |
| EP | 2 180 232 | 10/2008 |
| EP | 2 182 275 | 10/2008 |
| FR | 2 771 797 | 6/1999 |

* cited by examiner

LUMINAIRE AND TRAFFIC ROUTE ILLUMINATION DEVICE

RELATED APPLICATIONS

This is a U.S. national stage of application No. PCT/DE2010/068247, filed on Nov. 25, 2010.

This patent application claims the priority of German patent application 10 2009 056 385.7 filed Nov. 30, 2009, the disclosure content of which is hereby incorporated by reference.

A luminaire is provided. A traffic route illumination device is also provided.

BACKGROUND OF THE INVENTION

WO 2009/098081 A1 describes an illumination module, a luminaire and an illumination method.

An object to be achieved is to provide a luminaire which has a predeterminable radiation characteristic and which is glare-resistant or non-glare. In particular, an object to be achieved is to provide a traffic route illumination device which has a specific, predeterminable radiation characteristic and is glare-resistant.

SUMMARY OF THE INVENTION

In accordance with at least one embodiment of the luminaire, it includes at least one, preferably several, optoelectronic semiconductor devices. The semiconductor device can be a light-emitting diode or a light-emitting diode module. In particular, the semiconductor device is arranged to emit white light.

In accordance with at least one embodiment of the luminaire, it includes at least one primary optical unit. The primary optical unit is disposed downstream of the semiconductor device along a beam path and is spaced apart from the semiconductor device. For example, the primary optical unit is formed by a lens which directs radiation, which is emitted by the semiconductor device, into a specific solid angle region. The phrase "spaced part" can mean that no direct connection is established between a semiconductor material of the optoelectronic semiconductor device and the primary optical unit. In particular, a coupling medium, an air gap or an evacuated region is located between a radiation exit surface of the semiconductor device and a radiation entry surface of the primary optical unit.

In accordance with at least one embodiment of the luminaire, it includes a secondary optical unit. The secondary optical unit is disposed downstream of the primary optical unit along a beam path. In particular, the secondary optical unit is a reflective element.

In accordance with at least one embodiment of the luminaire, it includes a tertiary optical unit. The tertiary optical unit is disposed downstream of the secondary optical unit and/or the primary optical unit and in particular is arranged for transmission of the radiation generated by the semiconductor device.

In accordance with at least one embodiment of the luminaire, a proportion of at least 30%, in particular at least 50%, of the radiation emitted by the semiconductor device impinges upon the secondary optical unit and/or the tertiary optical unit.

In a preferred manner, the luminaire includes a secondary optical unit and also a tertiary optical unit. In this case, a proportion of radiation of at least 50% of the radiation emitted by the at least one optoelectronic semiconductor device impinges upon the secondary optical unit and/or upon the tertiary optical unit. The proportions of radiation which impinge upon the secondary optical unit and upon the tertiary optical unit can be mutually diverging proportions of radiation. The proportion of radiation which passes from the primary optical unit to the secondary optical unit also passes partially or preferably completely in a successive manner to the tertiary optical unit.

In accordance with at least one embodiment of the luminaire, the secondary optical unit and/or the tertiary optical unit is/are arranged for small-angle scattering of the radiation emitted by the semiconductor device. If the luminaire includes a secondary optical unit and also a tertiary optical unit, then in particular only the tertiary optical unit is arranged for small-angle scattering of the radiation and the secondary optical unit is an optical element which is reflective in accordance with the law of reflection.

For example, an average scattering cone of the radiation scattered by the secondary optical unit and/or the tertiary optical unit has an aperture angle between 0.5° and 10° inclusive, in particular between 1° and 5° inclusive. In other words, the radiation is expanded or scattered only moderately. It is possible for the scattering cone to be asymmetrical in formation. For example, the scattering cone can have an aperture angle of approximately 2° along an x-direction and can have an aperture angle of approximately 6° along a y-direction which is orthogonal thereto. An average aperture angle of the scattering cone is then derived preferably from half the sum of the aperture angles in the spatial directions, in the present example i.e. ca. 4°. In other words, a parallel beam bundle is converted by the secondary optical unit and/or the tertiary optical unit into a divergent beam bundle having the aperture angle. The aperture angle is e.g. an angle range in which a radiation intensity has fallen to 50% of a maximum intensity along a specific direction, abbreviated as an FWHM-angle. Likewise, the aperture angle can be a minimum angle range into which at least 68% or at least 95% of the radiation intensity of the incident, parallel beam bundle is emitted.

According to at least one embodiment of the luminaire, it includes at least one optoelectronic semiconductor device and at least one primary optical unit which is disposed downstream of the semiconductor device and is spaced apart therefrom. Furthermore, the luminaire comprises a secondary optical unit and preferably also a tertiary optical unit which are disposed downstream of the primary optical unit. A proportion of at least 30% of radiation emitted by the semiconductor device passes to the secondary optical unit and/or to the tertiary optical unit. Furthermore, the secondary optical unit and/or the tertiary optical unit is/are arranged for small-angle scattering of the radiation emitted by the semiconductor device.

Through the use of such a secondary optical unit and/or such a tertiary optical unit, it is possible to produce a luminaire which illuminates a region which in comparative terms is defined in an acutely delimitable manner, e.g. a road. Furthermore, small-angle scattering using the secondary optical unit and/or the tertiary optical unit serves to reduce the glare to which in particular road users are subjected.

In accordance with at least one embodiment of the luminaire, the secondary optical unit is designed as a reflector. In other words, the secondary optical unit reflects the radiation, which is directed by the primary optical unit to the secondary optical unit, into a specific solid angle region. In particular, the secondary optical unit is then formed so as to be impermeable to light.

In accordance with at least one embodiment of the luminaire, the tertiary optical unit is a scattering plate. In other words, the tertiary optical unit is then light-transmissive and is arranged for transmission of the visible radiation emitted by the semiconductor device. Likewise, it is additionally possible for the tertiary optical unit to be designed to be permeable to near-infrared radiation and/or impermeable to ultraviolet radiation.

In accordance with at least one embodiment of the luminaire, it includes the secondary optical unit and also the tertiary optical unit. The secondary optical unit is an optical element which is reflective in accordance with the law of reflection, i.e., the secondary optical unit is not arranged for small-angle scattering of the radiation. In this embodiment, only the tertiary optical unit which is disposed downstream of the secondary optical unit and the primary optical unit is arranged for small-angle scattering of the radiation.

In accordance with at least one embodiment of the luminaire, the secondary optical unit surrounds the semiconductor device and the primary optical unit in a lateral direction on all sides. For example, the semiconductor device and the primary optical unit are completely surrounded by the secondary optical unit in a horizontal direction.

In accordance with at least one embodiment of the luminaire, the secondary optical unit and the tertiary optical unit encase the semiconductor device and the primary optical unit on all sides. In other words, the secondary optical unit and the tertiary optical unit can form a type of box, in which the semiconductor device and also the primary optical unit are located. The box can be formed not only by the secondary optical unit and the tertiary optical unit but also by a carrier of the semiconductor device. It is possible for the semiconductor device and the primary optical unit to be sealed in a dust-proof manner in the box.

In accordance with at least one embodiment of the luminaire, the secondary optical unit has a paraboloidal or an ellipsoidal basic form in a cross-section, perpendicular to a longitudinal direction of the secondary optical unit. For example, the secondary optical unit is formed as a half ellipse in cross-section. In particular, the secondary optical unit can have an asymmetric cross-section.

In accordance with at least one embodiment of the luminaire, the secondary optical unit has a concave, biconcave, convex, biconvex or rectangular basic form in plan view along the longitudinal direction. In other words, an expansion and/or an internal dimension of the secondary optical unit, perpendicular to the longitudinal direction, in particular as seen in plan view, can assume different values at different points on the secondary optical unit.

In accordance with at least one embodiment of the luminaire, the secondary optical unit is divided into a plurality of blades in a direction perpendicular to the longitudinal direction. In particular, blades are regions which are elongate, preferably connected along the longitudinal direction, mutually adjacent and/or consecutive, e.g. regions of inner sides of the secondary optical unit, wherein the blades can form base elements of a reflective optical unit of the secondary optical unit and the blades or groups of blades can be formed from a connected material which is rigid during operation of the luminaire. Individual blades can be delimited from each other by an edge. As seen in a cross-section, the at least one inner side of the secondary optical unit can then be structured in the manner of saw teeth. For example, the secondary optical unit comprises between 10 and 30 blades inclusive along the cross-section.

In accordance with at least one embodiment of the luminaire, the secondary optical unit comprises, in particular in a direction perpendicular to the longitudinal direction, at least one connected lateral part or is formed by a single, connected workpiece perpendicular to the longitudinal direction along the entire cross-section. In particular, an inner side of the lateral portions and/or of the entire connected workpiece of the secondary optical unit can be described, perpendicular to the longitudinal direction, by a once or twice continuously differentiable function. For example, the at least one inner side or the function which describes the inner side specifically in cross-section then has a sinusoidal progression. The at least one inner side is subdivided into a plurality of blades preferably in the direction perpendicular to the longitudinal direction, wherein individual ones of the blades are delimited or separated from one another e.g. by a change in the curvature of the function, which describes the inner surface, or by minima of this function.

In accordance with at least one embodiment of the luminaire, the secondary optical unit comprises mutually plane-parallel terminal surfaces in particular in the direction transverse or perpendicular to the longitudinal direction. The terminal surfaces are thus oriented preferably in parallel with a plane which is aligned transversely with respect to the longitudinal direction. Preferably, the terminal surfaces are designed to be reflective and light-impermeable. Alternatively, it is also possible for the terminal surfaces to be radiolucent and then preferably subject any radiation passing through to small-angle scattering.

In accordance with at least one embodiment of the luminaire, the blades comprises along the longitudinal direction a curved progression which deviates from a straight line. For example, several sections are assembled along the longitudinal direction to form a blade or the blade has one or several bends along the longitudinal direction. Such blades are comparatively simple to produce. Likewise, it is possible for the blades to be formed along the longitudinal direction from a connected, single-piece material and to be described by a once continuously differentiable function. Such blades can be used to reduce any discontinuities or undesired fluctuations in a luminosity profile to be generated by the luminaire. Furthermore, the blades can have a different width in a central region of the secondary optical unit than near the terminal surfaces, seen along the longitudinal direction.

In accordance with one embodiment of the luminaire, one or two main sides of the tertiary optical unit comprise(s) a surface profile. The surface profile can be formed by microlenses which are formed in the main sides. In particular, a maximum gradient of the surface profile, in relation to in particular one of the main expansion directions of the tertiary optical unit, amounts to between 2° and 14° inclusive, preferably between 3° and 10° inclusive, in particular between 4° and 6° inclusive.

In accordance with at least one embodiment of the luminaire, a beam profile of the radiation emitted by the luminaire is asymmetrical in particular in a direction perpendicular to the longitudinal direction of the secondary optical unit. For example, the beam profile has a maximum in an angle range between 30° and 80° inclusive, in particular between 50° and 80° inclusive, preferably between 60° and 75° inclusive. In other words, a maximum radiation intensity is emitted in this angle range. The angle range or the angle can refer e.g. to an optical axis of the semiconductor device.

The beam profile of the luminaire can have one maximum or even two maxima which are then disposed preferably symmetrically with respect to the optical axis. If the beam profile only has one maximum e.g. between 30° and 80° inclusive, then preferably in an angle range between 20° and −90° inclusive, a radiation intensity is at most 40% or at most 30% of the intensity in the maximum.

A traffic route illumination device is also provided. The traffic route illumination device includes e.g. at least one luminaire, as described in conjunction with one or several of the aforementioned embodiments. Features of the luminaire are thus also disclosed for the traffic route illumination device and vice versa.

In at least one embodiment of the traffic route illumination device, it includes at least one luminaire, preferably two or more than two luminaires, as described in conjunction with at least one of the aforementioned embodiments.

In accordance with at least one embodiment of the traffic route illumination device, which includes a plurality or multiplicity of luminaires, these luminaires are arranged in the manner of a matrix.

In accordance with at least one embodiment of the traffic route illumination device, at least two of the luminaires are disposed so as to be tilted relative to one another along a longitudinal direction of one of the luminaires and/or along a vertical direction. This ensures that a large region can be illuminated by the traffic route illumination device.

In accordance with at least one embodiment of the traffic route illumination device, it includes various luminaires which are not constructed in the same way. In particular, the luminaires can differ from each other in an angle of radiation range. For example, a near range of the traffic route illumination device can be illuminated by one luminaire and a far range of the traffic route illumination device can be illuminated by a further one of the luminaires.

Such traffic route illumination devices can be used e.g. for illuminating tracks, roads, footpaths or cycle paths, in particular in the form of stationary lamps.

BRIEF DESCRIPTION OF THE DRAWINGS

A luminaire described in this case and a traffic route illumination device described in this case will be explained in greater detail hereinafter with reference to the drawing with the aid of exemplified embodiments. In the individual Figures, like reference numerals designate like elements. However, none of the references are illustrated to scale, on the contrary individual elements can be illustrated in greatly exaggerated fashion for improved understanding. In the drawing.

DETAILED DESCRIPTION OF THE DRAWINGS

Figure 1:
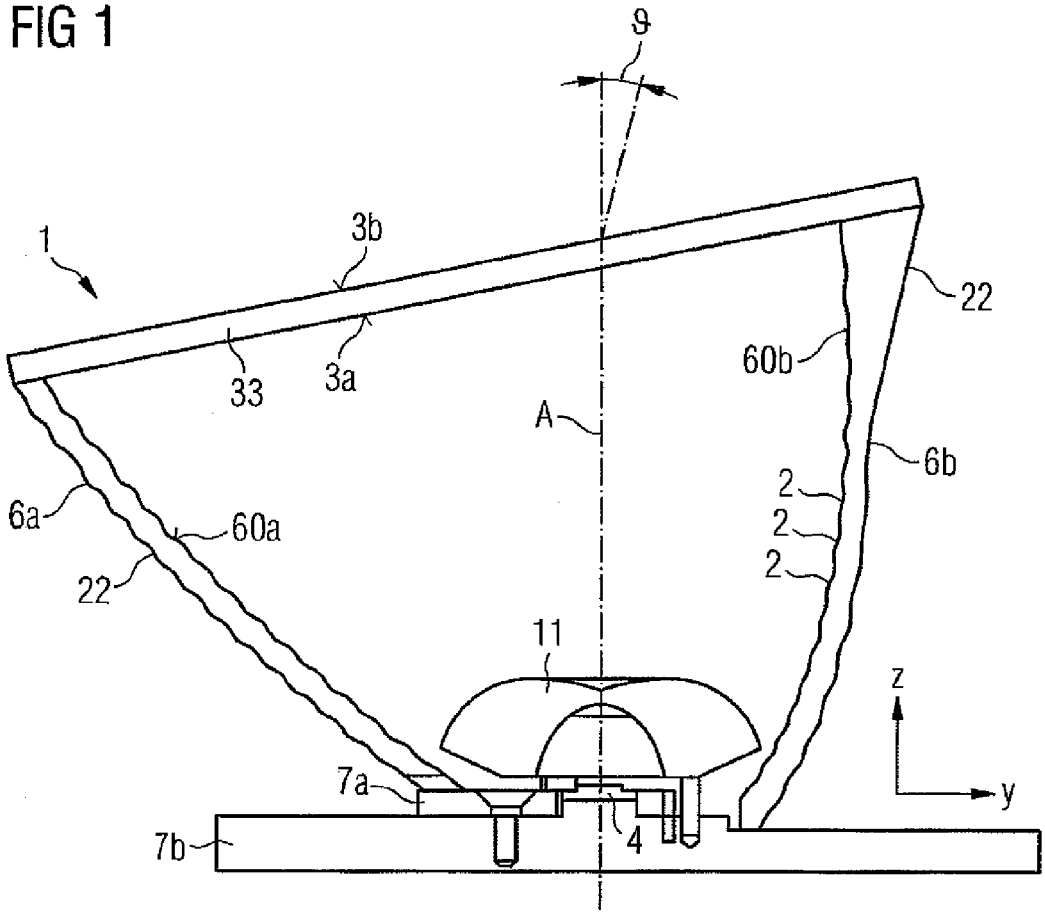
FIG. 1 shows a schematic sectional illustration of an exemplified embodiment of a luminaire described in this case.

FIG. 1 illustrates an exemplified embodiment of a luminaire 1. The luminaire 1 includes a carrier 7*b*, on which a mounting plate 7*a* is placed. An optoelectronic semiconductor device 4, e.g. having one or several light-emitting diodes, is mounted on the carrier 7*b*. Spaced apart from the semiconductor device 4, a primary optical unit 11 is mounted on the mounting plate 7*a*. A minimum distance between a light entry surface of the primary optical unit 11, which is formed as a lens, and a light-irradiating main side of the semiconductor device 4 is in particular between 0.5 mm and 30 mm inclusive, preferably between 4 mm and 20 mm inclusive. The semiconductor device 4 and the primary optical unit 11 can be designed in the manner described in document WO 2009/098081 A1. The disclosure content of this document with regard to the luminaire 1 is incorporated by reference. A luminous flux of the at least one semiconductor device 4 and/or the luminaire 1 is preferably at least 750 lm, in particular at least 1000 lm.

A z-direction is defined by an optical axis A of the semiconductor device 4 which represents e.g. an axis of symmetry of a radiation characteristic of the semiconductor device 4 or a perpendicular of a main surface of a semiconductor chip of the semiconductor device 4. The optical axis A of the semiconductor device 4 coincides in particular with an axis of symmetry of the primary optical unit 11. Preferably, the optical axis A is also oriented perpendicularly with respect to the carrier 7*b*.

Furthermore, the luminaire 1 includes a secondary optical unit 22 which comprises a multiplicity of blades 2. In FIG. 1 the secondary optical unit 22 is schematically illustrated merely in a simplified manner. The secondary optical unit 22 comprises two lateral parts 6*a*, 6*b* which comprise inner sides 60*a*, 60*b* with the blades 2. Formed on an underside of the secondary optical unit 22 facing towards the carrier 7*b* is a cut-out, through which the semiconductor device 4 and the primary optical unit 11 penetrate.

On a side of the secondary optical unit 22 facing away from the semiconductor device 4, the semiconductor device 4 is covered in the manner of a top cover by a single-piece tertiary optical unit 33 which is designed as a scattering plate. It is also possible for only the secondary optical unit 22 to be arranged for small-angle scattering and for the tertiary optical unit 33 to be a plane-parallel, non-scattering plate. The tertiary optical unit 33 is preferably attached to the secondary optical unit 22 and comprises a main side 3*a* facing towards the semiconductor device 4, and a main side 3*b* facing away from the semiconductor device 4.

Radiation which is emitted by the semiconductor device 4 is directed from the primary optical unit 11 at a proportion of at least 50%, in particular at a proportion of at least 70%, to the secondary optical unit 22. The radiation also passes from the secondary optical unit 22 to the tertiary optical unit 33 which is arranged to have radiation pass through it. Likewise, a proportion of the radiation emitted by the semiconductor device 4 passes via the primary optical unit 11 directly to the tertiary optical unit 33, without being reflected by the secondary optical unit 22.

Figure 2A:
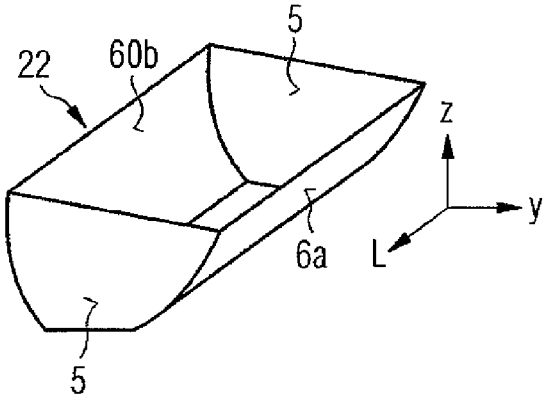
FIGS. 2 to 9 show schematic illustrations of exemplified embodiments of secondary optical units and of tertiary optical units for luminaires described in this case.
Figure 2B:
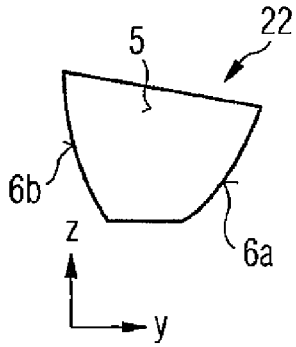
Figure 2C:
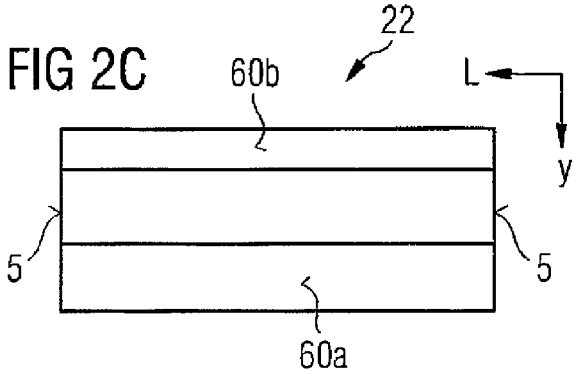

FIG. 2A is a three-dimensional illustration of only the secondary optical unit 22, FIG. 2B is a schematic lateral view and FIG. 2C is a schematic plan view. The blades 2 on the inner sides 60*a*, 60*b* are not illustrated in FIG. 2. The secondary optical unit 22 comprises two terminal surfaces 5 which are disposed in a plane-parallel manner with respect to each other and in each case perpendicularly with respect to the longitudinal direction L. The blades which are not illustrated in FIG. 2 can be disposed in parallel with each other along a longitudinal direction L. Along the longitudinal direction L, the secondary optical unit 22 and/or the luminaire 1 has e.g. an expansion between 60 mm and 100 mm inclusive, e.g. ca. 80 mm. Along the y-direction, an expansion of the secondary optical unit 22 and/or of the luminaire 1 is e.g. between 30 mm and 100 mm inclusive, in particular ca. 60 mm. An expansion along the z-direction can be between 30 mm and 90 mm inclusive, e.g. ca. 50 mm.

Figure 3A:
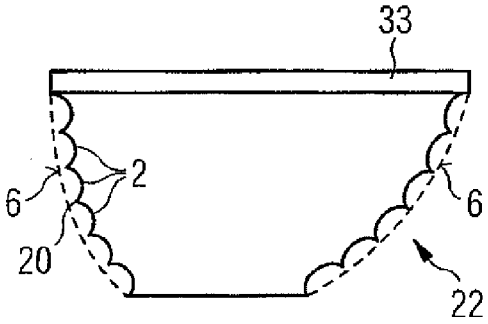
Figure 3B:
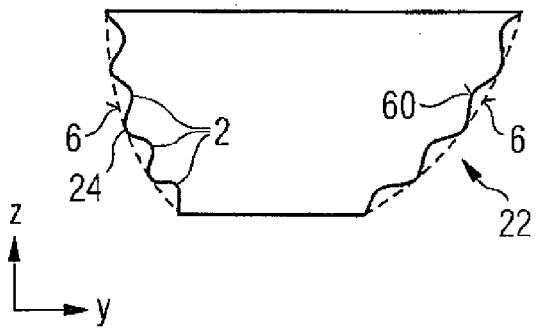

FIGS. 3A and 3B illustrate cross-sections of the secondary optical unit 22. An average progression of the lateral parts 6 is indicated by a broken line. As in the other Figures, the number of blades 2 can deviate from the number shown. In accordance with FIG. 3A, the blades 2 are separated from each other at the lateral parts 6 in each case by edges 20. The edges 20 can be produced by a bend e.g. in a metal sheet, from which the secondary optical unit 22 is formed. As in all of the other exemplified embodiments, the secondary optical unit 22 can also be formed in one piece, e.g. from a single metal sheet or a single injection-moulded part having a reflective coating. In accordance with FIG. 3B, the inner sides 60 of the lateral parts 6 can be described by a once continuously differentiable function. The blades 2 are separated from each other by minima 24.

Unlike in FIGS. 1 and 2, edges of the secondary optical unit 22 which define the secondary optical unit 22 along the z-direction are disposed in parallel with each other. In order to simplify the graphical illustration, a cut-out, e.g. for receiving the semiconductor device 4, is not illustrated in FIG. 3.

Figure 4A:
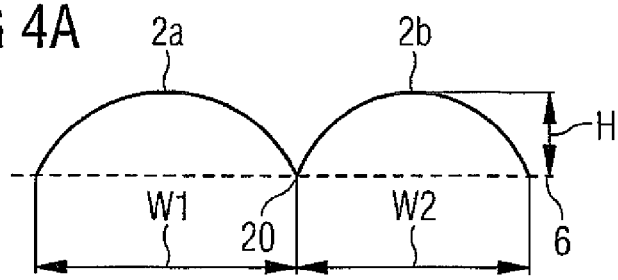

FIGS. 4 and 5 schematically illustrate more detailed cross-sections of the blades 2 of the secondary optical unit 22. In accordance with FIG. 4A, the blades 2*a*, 2*b* have the same heights H but different widths W1, W2. The blades 2*a*, 2*b* each have a convex form. The height H is e.g. between 50 μm and 1000 μm inclusive, the widths W1, W2 are e.g. between 1.0 mm and 10 mm inclusive.

Figure 4B:
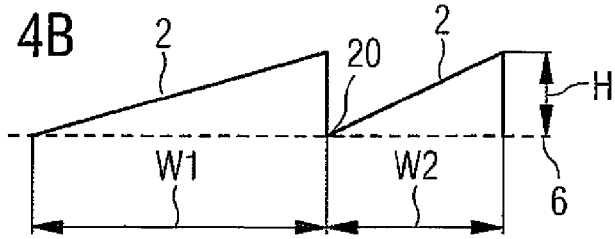
Figure 4C:
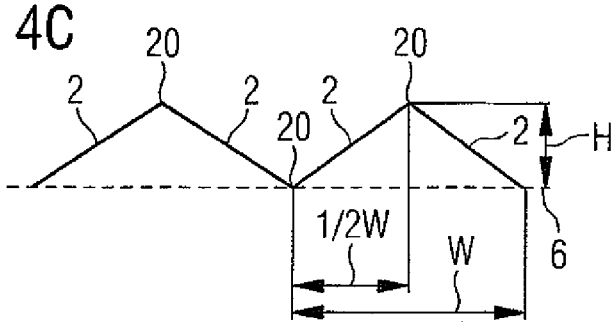

In accordance with FIG. 4B and FIG. 4C, the blades 2 are formed in the manner of saw teeth. The individual blades 2 are formed asymmetrically in accordance with FIG. 4B, and symmetrically in accordance with FIG. 4C.

Figure 5A:
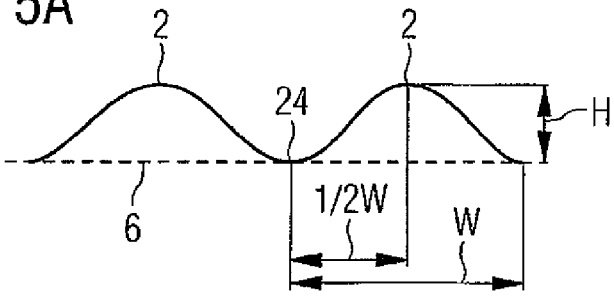
Figure 5B:
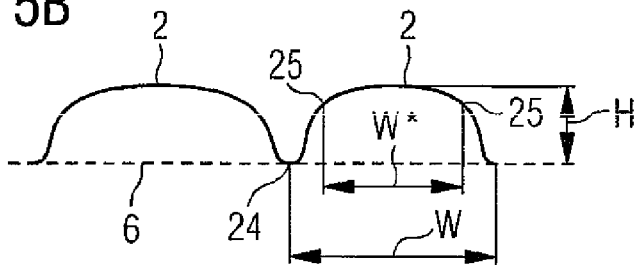

As illustrated in FIGS. 5A and 5B, a progression of the blades 2 can be reproduced by a once or twice continuously differentiable function. In accordance with FIG. 5A, the blades are sinusoidal in formation, wherein the notional boundary between two adjacent blades 2 is provided by a minimum 24 of the function. In FIG. 5B, the sinusoidal progression of the blades 2 is upset. An inner width W* of the blades 2 between two turning points of the function 25 constituting the blades 2 is e.g. between 60% and 85% inclusive of the entire width W of one of the blades 2.

Figure 6A:
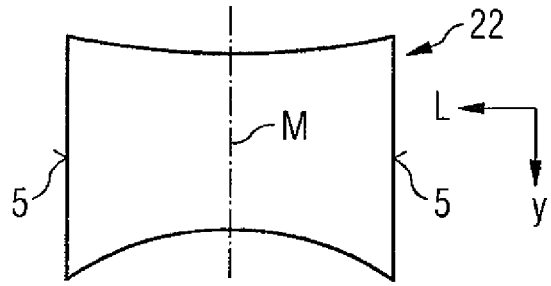

FIG. 6A shows a schematic plan view of the secondary optical unit 22. The blades 2 are not illustrated in FIG. 6A. Along the longitudinal direction L, the secondary optical unit 22 has a biconcave form, wherein curvatures which define the secondary optical unit 22 in the +y-direction and in the −y-direction deviate from each other.

Figure 6B:
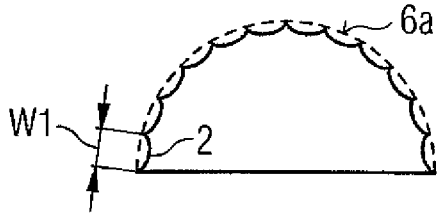
Figure 6C:
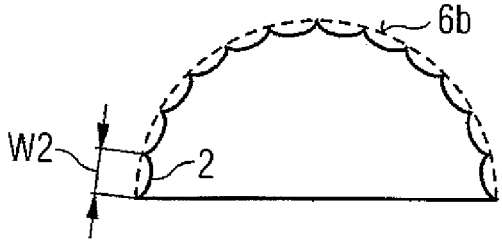

A cross-section along the centre M of the secondary optical unit 22 as shown in FIG. 6A, cf. the dot-dash line, is shown in FIG. 6B, a cross-section in the y-direction close to the terminal surfaces 5 is shown in FIG. 6C. Along the centre M, a cross-section of the secondary optical unit 22 is smaller than at the terminal surfaces 5. The number of blades 2 is constant along the entire longitudinal direction L, whereby the blades 2 in the centre M have a smaller width W1 than at the terminal surfaces 5, at which the blades 2 have a greater width W2. Furthermore, the blades 2 can preferably be described along the longitudinal direction L by a once continuously differentiable function. This renders it possible to achieve very uniform illumination of a region using the luminaire 1, particularly if the blades are formed perpendicularly with respect to the longitudinal direction L, similar to FIG. 3B, 5A or 5B.

Figure 7:
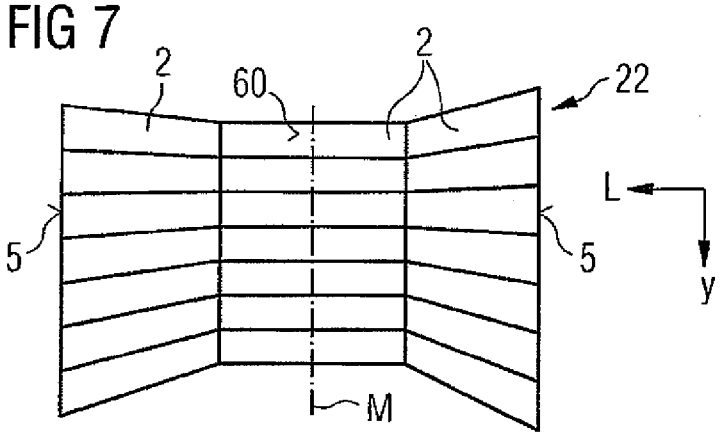

FIG. 7 illustrates a plan view of a further exemplified embodiment of the secondary optical unit 22. Along the longitudinal direction L, several blades 2 are attached or assembled so that individual blades 2 have a comparatively simple geometry and can be formed efficiently. As in the case of FIG. 6A, the basic form of the secondary optical unit 22 is biconcave in relation to the longitudinal direction L. A cross-section of the secondary optical unit 22 as shown in FIG. 7 can be presented in a manner similar to FIGS. 6A, 6C. Unlike the illustrations in FIGS. 6 and 7, the blades 2 can be formed in the same way as illustrated in FIGS. 4 and 5.

As in all of the other exemplified embodiments, it is likewise possible for the number of blades 2 to change along the longitudinal direction L. For example, the secondary optical unit 22 as shown in FIG. 7 can have more or fewer blades 2 on the terminal surfaces 5 than along the centre M. Preferably, the number of blades 2 in various regions along the longitudinal direction L then deviates from one another by a maximum of a factor of 2 and in particular by at least a factor of 1.2.

Figure 8A:
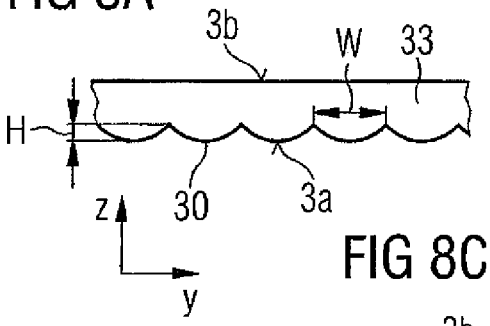
Figure 8B:
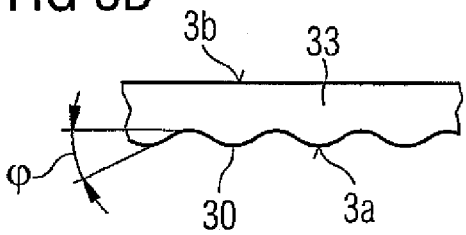
Figure 8C:
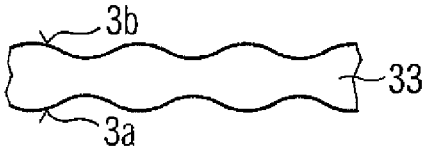

FIGS. 8A, 8B, 8C illustrate exemplified embodiments of the tertiary optical unit 33. It is possible for the tertiary optical unit 33 to be formed in one piece and/or for the two main surfaces 3*a*, 3*b* to be mutually plane-parallel on average. The tertiary optical unit 33 can be formed from or consist of a glass or a synthetic material. The tertiary optical unit 33 can comprise microlenses 30 on the main side 3*a* facing towards the semiconductor device 4 and/or on the main side 3*b* facing away from the semiconductor device 4. A maximum gradient $\phi$ of the microlenses 30 is preferably between 4° and 6° inclusive. In particular, the height H of the microlenses 30 is between 25 μm and 250 μm inclusive. The width W of the microlenses 30 is e.g. between 0.2 mm and 5 mm inclusive.

Figure 9A:
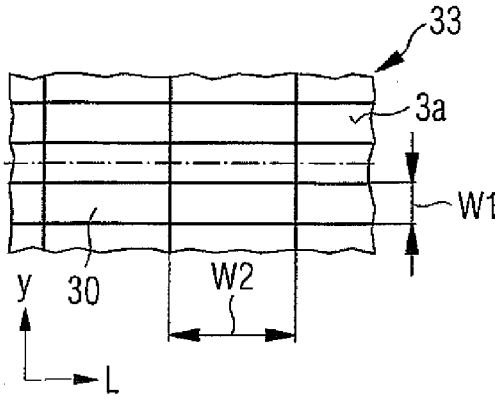
Figure 9B:
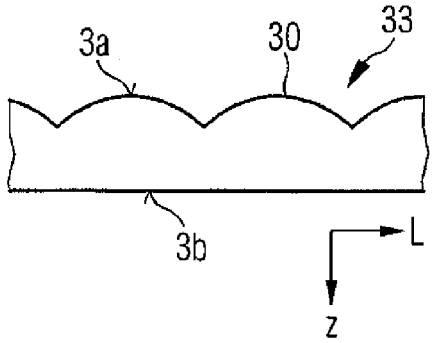

In accordance with FIG. 9, the tertiary optical unit 33 has a matrix-like arrangement of the microlenses 30. The microlenses 30 have different widths W1, W2 along the longitudinal direction L and along the y-direction. Specifically along the longitudinal direction L, adjacent microlenses 30 can have a sinusoidal progression, similar to FIG. 5A or 5B, or can also be separated from each other by sharp edges, similar to FIG. 4A.

The microlenses 30 of the tertiary optical unit 33 and/or the blades 2 of the secondary optical unit 22 can have a spherical, aspherical, circular, elliptical form or a form extruded linearly in the L-direction or y-direction, or can be formed as surface waves in the y-direction and/or sinusoidally along the longitudinal direction L. It is also possible for the microlenses 30 and/or the blades 2 to be formed as free-form surfaces or free-form optical units.

Figure 10A:
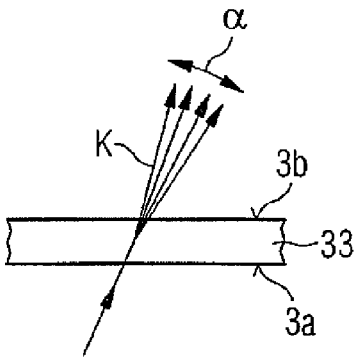
FIGS. 10, 11 and 13 show schematic illustrations of the radiation characteristics of exemplified embodiments of luminaires and traffic route illumination devices described in this case.

FIG. 10A illustrates the small-angle scattering of the tertiary optical unit 33. An incident, parallel beam bundle is expanded e.g. by means of scattering centres in the plane-parallel tertiary optical unit 33 into a scattering cone K having an average aperture angle $\alpha$. Preferably, the aperture angle $\alpha$ is between 1° and 5° inclusive.

Figure 10B:
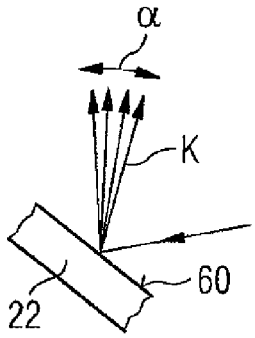

In accordance with FIG. 10B, the small-angle scattering is effected during reflection at one of the inner sides 60 of the secondary optical unit 22. Preferably, the beam is likewise expanded into the scattering cone K with the average aperture angle $\alpha$ between 1° and 3° inclusive.

Figure 10C:
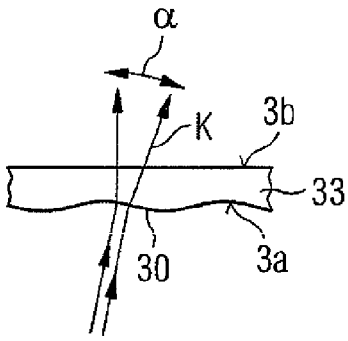

FIG. 10C illustrates that an incident parallel beam bundle undergoes scattering or beam expansion at one of the microlenses 30. The beam expansion over the microlenses 30 is e.g. between 2° and 3° inclusive.

Figure 10D:
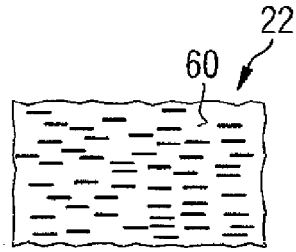

FIG. 10D illustrates a possible structuring of the inner sides 60 of the secondary optical unit 22 or even a roughening of one of the main sides 3*a*, 3*b* of the tertiary optical unit 33. The roughening can be statistical roughening which is formed e.g. by a type of statistically distributed, elongate trenches, oriented along a specific direction. By means of this type of structuring, a scattering cone K can be produced which has different aperture angles e.g. along the longitudinal direction L and along the y-direction.

Figure 11A:
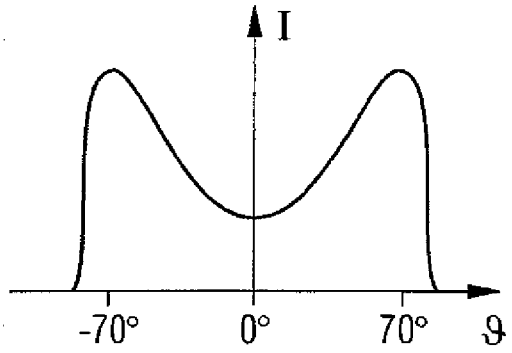
Figure 11B:
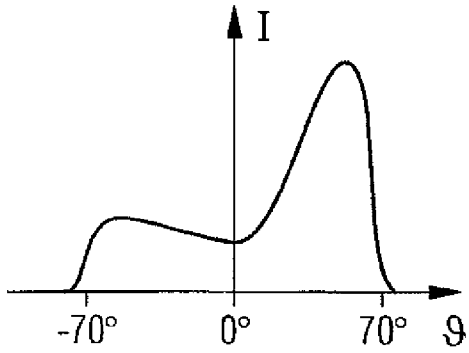

FIGS. 11A and 11B illustrate beam profiles which can be produced by a luminaire 1 described in this case. An intensity I is plotted as a function of an emission angle θ, cf. FIG. 1. In accordance with FIG. 11A, the beam profile in the y-L-plane is symmetrical with respect to the optical axis A and has two maxima at −70° and +70°. Along the optical axis A at θ=0°, the intensity I is at most 30% of the maximum intensity.

In accordance with FIG. 11B, the beam profile has merely one maximum at ca. θ=70°. In the angle range of 20° to −90° inclusive, the intensity I is at most 30% of the maximum intensity.

Figure 12A:
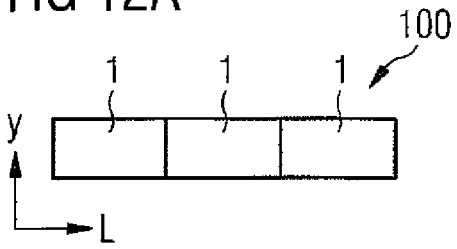
FIG. 12 shows schematic illustrations of exemplified embodiments of traffic route illumination devices described in this case.
Figure 12B:
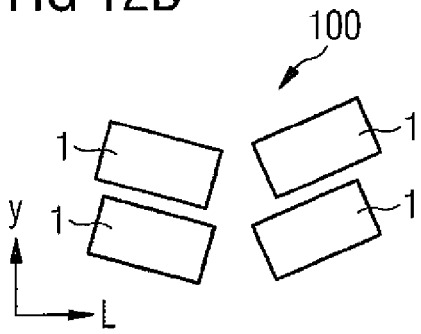
Figure 12C:
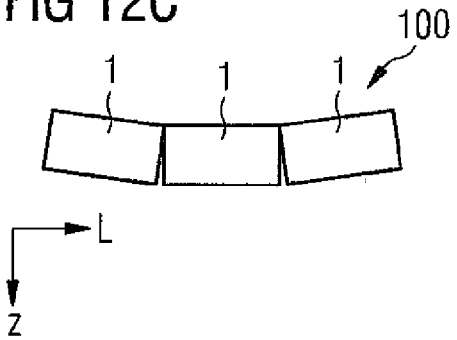

FIG. 12 illustrates exemplified embodiments of a traffic route illumination device 100. In accordance with FIG. 12A, three of the luminaires 1 are disposed in a linear manner. In accordance with FIG. 12B, the luminaires 1 are arranged in the manner of a matrix and tilted with respect to each other in the y-L-plane. In accordance with FIG. 12C, the luminaires 1 are rotated with respect to each other in the z-L-plane. The traffic route illumination device 100 can include differentially configured luminaires 1.

Particularly in the case of the luminaires 1 as shown in FIG. 12A, as well as in all other exemplified embodiments, it is possible for the secondary optical unit 22 to have no terminal surface's. Preferably, terminal surfaces are only provided at ends of the module 100 along the longitudinal direction L, so that the entire module 100 then has a total of only two terminal surfaces. Such luminaires 1 or modules 100 render it possible to reduce the number of terminal surfaces and a modular arrangement of the luminaires 1 can be simplified.

Figure 13:
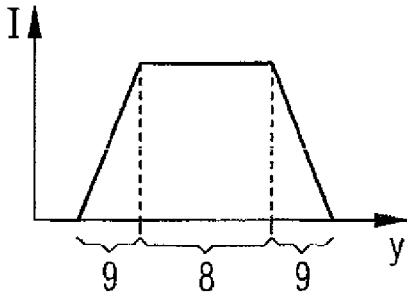

FIG. 13 illustrates a beam profile of the traffic route illumination device 100, e.g. in accordance with FIG. 12C. In particular, a road 8 is illuminated with uniform intensity I. Along a cycle path 9 and/or a footpath 9, the intensity I decreases e.g. linearly.

The invention described in this case is not restricted by the description with reference to the exemplified embodiments. On the contrary, the invention includes each new feature and each combination of features, including in particular each combination of features in the claims, even if this feature or this combination itself is not explicitly stated in the claims or exemplified embodiments.

The invention claimed is:

1. A luminaire comprising:

at least one optoelectronic semiconductor device;

at least one primary optical unit which is disposed downstream of the semiconductor device and is spaced apart from the semiconductor device; and a secondary optical unit and a tertiary optical unit which are disposed downstream of the primary optical unit, wherein a proportion of at least 50% of radiation emitted by the semiconductor device passes to the secondary optical unit and to the tertiary optical unit, wherein the secondary optical unit and the tertiary optical unit are arranged for small-angle scattering of the radiation such that an average scattering cone of the radiation scattered by the secondary optical unit and the tertiary optical unit has an aperture angle between 1° and 5° inclusive, wherein the secondary optical unit comprises two terminal surfaces which are disposed in plane-parallel manner with respect to each other and in each case perpendicularly with respect to a longitudinal direction, wherein the secondary optical unit is subdivided into a plurality of blades in a direction perpendicular to the longitudinal direction so that the blades are disposed in parallel with each other along the longitudinal direction and all the blades are formed from a connected, single-piece material and can be described by a once continuously differentiable function in the direction perpendicular to the longitudinal direction, wherein a boundary between two adjacent blades is defined by a minimum of the continuously differentiable function and a distance between two minima corresponds to an entire width of the corresponding blade, and wherein an inner width of the blades between two turning points of the continuously differentiable function constituting the blades is between 60% and 65% inclusive of the entire width of the corresponding blade when seen in a cross-sectional view.

2. The luminaire as claimed in claim 1, wherein the secondary optical unit is a reflector and the tertiary optical unit is a scattering plate.

3. The luminaire as claimed in claim 1, wherein the secondary optical unit surrounds the semiconductor device and the primary optical unit laterally on all sides, and wherein the secondary optical unit and the tertiary optical unit surround the semiconductor device and the primary optical unit on all sides.

4. The luminaire as claimed in claim 1, wherein the secondary optical unit has a paraboloidal and/or an ellipsoidal basic form in a cross-section perpendicular to a longitudinal direction, and wherein the secondary optical unit has a concave, biconcave, convex or biconvex basic form in plan view along the longitudinal direction.

5. The luminaire as claimed in claim 1, wherein the secondary optical unit comprises mutually plane-parallel terminal surfaces which limit the secondary optical unit along a longitudinal direction, and wherein the blades have in a centre, along the longitudinal direction, a different width than at the terminal surfaces.

6. The luminaire as claimed in claim 1, wherein one or two main sides of the tertiary optical unit is/are provided with a surface profile, wherein a maximum gradient of the surface profile is between 2° and 14° inclusive.

7. The luminaire as claimed in claim 1, wherein one or two of the main sides of the tertiary optical unit is/are provided with microlenses.

8. The luminaire as claimed in claim 1, wherein, in a direction perpendicular to the longitudinal direction, a beam profile has a maximum in an angle range between 30° and 80° inclusive, wherein in an angle range between 20° and −90° inclusive a radiation intensity amounts to at most 30% in relation to the maximum.

9. The luminaire as claimed in claim 1, wherein an average scattering cone of the radiation scattered by the secondary optical unit and/or the tertiary optical unit has an aperture angle between 1° and 5° inclusive.

10. A luminaire comprising:

at least one optoelectronic semiconductor device;

exactly one primary optical unit which is disposed downstream of the semiconductor device and is spaced apart from the semiconductor device; and a secondary optical unit and a tertiary optical unit which are disposed downstream of the primary optical unit, wherein a proportion of at least 50% of radiation emitted by the semiconductor device passes to the secondary optical unit and to the tertiary optical unit, wherein the secondary optical unit or the tertiary optical unit is arranged for small-angle scattering of the radiation, wherein an average scattering cone of the radiation scattered by the secondary optical unit or the tertiary optical unit has an aperture angle between 0.5° and 10° inclusive, wherein the secondary optical unit is subdivided into a plurality of blades in a direction perpendicular to a longitudinal direction, wherein individual ones of the blades are delimited from each other by an edge, wherein the secondary optical unit comprises exactly two terminal surfaces which limit the secondary optical unit along the longitudinal direction, the terminal surfaces being mutually plane-parallel reflective and light-impermeable surfaces oriented perpendicular to the longitudinal direction, and wherein the blades have in a centre, along the longitudinal direction, a different width than at the terminal surfaces.

11. A traffic route illumination device having at least one luminaire in accordance with claim 10.

12. The traffic route illumination device as claimed in claim 11, which comprises two or more than two of the luminaires, wherein the luminaires are arranged in the manner of a matrix and at least two of the luminaires are tilted relative to each other along a longitudinal direction and/or along a vertical direction.

* * * * *